US008734589B1

(12) United States Patent
Ackerman et al.

(10) Patent No.: US 8,734,589 B1
(45) **Date of Patent: *May 27, 2014**

(54) USE OF LIQUID FLUSHING COMPOSITION IN CLEANING A HEAT EXCHANGER

(75) Inventors: Eva Ackerman, Houston, TX (US); Yanwei Cen, Houston, TX (US); William Francis Flynn, Houston, TX (US); Richard Garza, Houston, TX (US)

(73) Assignee: The Rectorseal Corporation, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/593,221

(22) Filed: Aug. 23, 2012

Related U.S. Application Data

(62) Division of application No. 12/557,780, filed on Sep. 11, 2009, now Pat. No. 8,298,345.

(51) Int. Cl.
*B08B 9/093* (2006.01)
*B08B 3/02* (2006.01)

(52) U.S. Cl.
USPC ..... 134/22.13; 134/22.14; 134/22.18; 134/22.19; 134/36; 134/37

(58) Field of Classification Search
USPC ..... 134/22.1, 22.12, 22.13, 22.14, 22.18, 134/22.19, 36, 37
See application file for complete search history.

(56) References Cited

U.S. PATENT DOCUMENTS

| | | | | |
|---|---|---|---|---|
| 2,281,695 | A * | 5/1942 | James et al. | 134/23 |
| 4,597,416 | A * | 7/1986 | Scales | 137/899.4 |
| 5,425,333 | A * | 6/1995 | Baylor et al. | 123/41.14 |
| 8,298,345 | B1 * | 10/2012 | Ackerman et al. | 134/22.1 |
| 2006/0046945 | A1 * | 3/2006 | Herdt et al. | 510/234 |

* cited by examiner

*Primary Examiner* — Saeed T Chaudhry
(74) *Attorney, Agent, or Firm* — John Wilson Jones; Jones & Smith, LLP

(57) ABSTRACT

A heat exchanger may be cleaned by introducing compressed nitrogen and a flushing composition through an injection device.

20 Claims, 1 Drawing Sheet

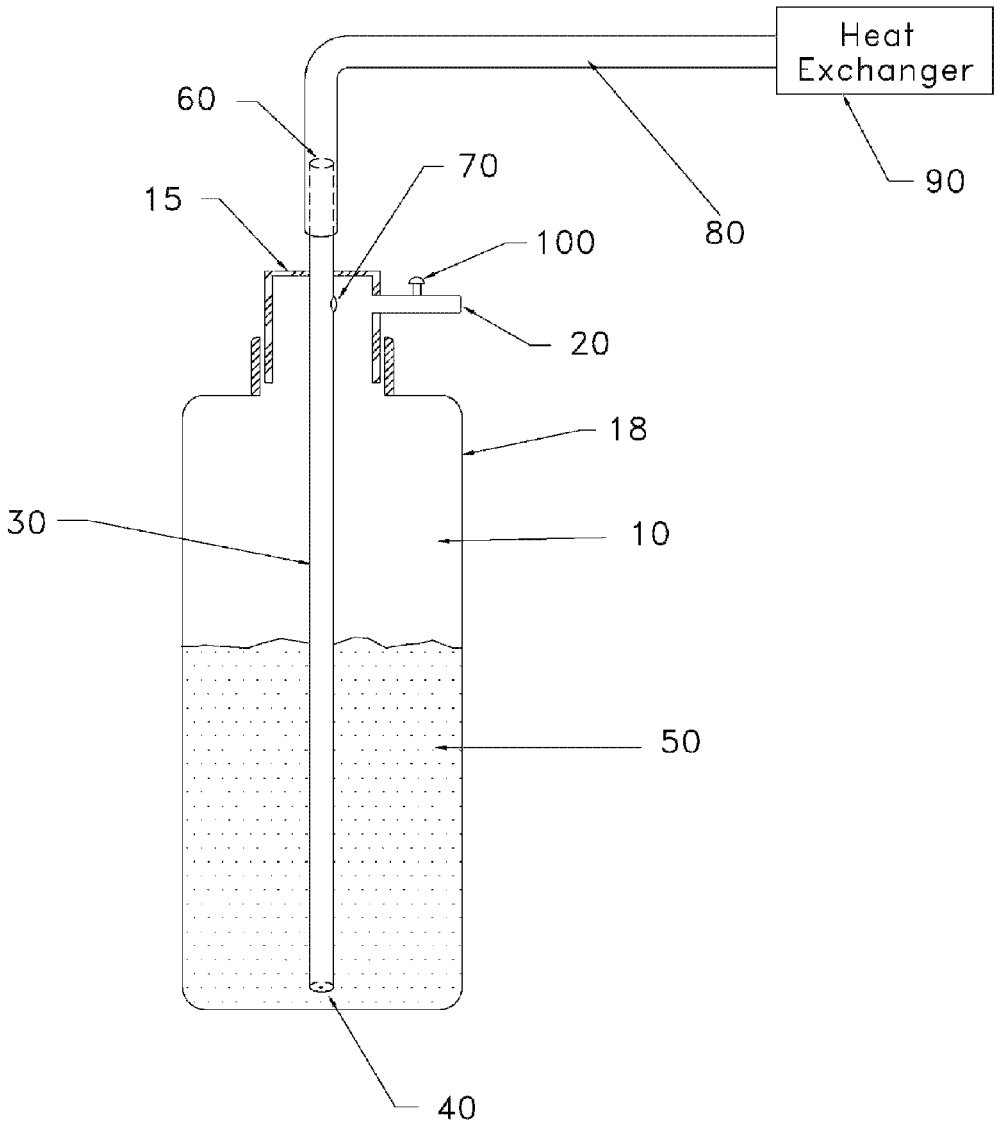
Heat Exchanger
60
70
15
100
80
90
20
18
30
10
50
40

USE OF LIQUID FLUSHING COMPOSITION IN CLEANING A HEAT EXCHANGER

SPECIFICATION

This application is a divisional application of U.S. patent application Ser. No. 12/557,780, filed on Sep. 11, 2009, now U.S. Pat. No. 8,298,345.

FIELD OF THE INVENTION

This invention generally relates to a method for cleaning the interior of a heat exchanger, such as a refrigeration or air conditioning system. The method feeds simultaneously nitrogen and a chemical composition into an injection device to enhance the cleaning capability. The chemical composition contains a chemical neutralizer to remove the acid residue in the system.

BACKGROUND OF THE INVENTION

Air conditioning and refrigeration system are widely used in industry, commercial buildings and residential housing. During operation of these systems, a compressor circulates fluid consisting of a lubricating refrigeration oil and a refrigerant through a condenser and evaporating coil to transfer the heat.

Over prolonged usage, air conditioning and refrigeration systems become contaminated with moisture, sludge, and other particulates. Such contaminants, together with the lubricating oil and refrigerant, can form acids in the system. These accumulated acids eventually cause compressor burnout. The term compressor burnout is used to describe a disabling electrical failure in the compressor's electric motor. The compressor burnout, in turn, creates more acids and other contaminants that adhere on the inside wall of the system. Thus, the system is required to be flushed to remove these acids and contaminants.

Most flushing methods require a mechanical pump to circulate the flushing composition through coils and/or system. This demands a volume of flushing composition to be used, at least to fill the coils. Typically, in a residential unit, at least 3 gallons of flushing composition may be required.

Other flushing methods use a disposable aerosol container which contains a flushing composition and propellant. The pressure is limited by the amount of the propellant in the container. The requisite pressure often decreases during the process. The disposal of such containers further burden the environment.

A need exists therefore for a more efficient method of providing a flushing composition into the interior of heat exchangers. Since current methodologies favor aerosol pumps over mechanical pumps in light of their ease in servicing heat exchangers, the efficiency of new alternatives would preferably not be dependent on the amount of propellant in the container. Alternatives have further been sought which lighten the burdens placed on the environment from current flushing products.

In addition, alternatives have been sought for a flushing composition, preferably to be used with novel methods, which do not contain chlorinated solvents. Most current flushing compositions use such chlorinated solvents as trichloroethylene, perchloroethylene, chloroform, methylene chloride, CFC 113, trichlorotrifluoroethane and various other hydrochlorofluorocarbons. While these solvents dissolve organic residues well, they do not impact inorganic acids.

Furthermore, these solvents are known to deplete ozone. In the United States, they are being phased out of production and/or banned from use.

There is a need for an improved flushing composition that cleans the contaminated air conditioning and refrigeration system more economically and removes the acids from the system more efficiently.

SUMMARY OF THE INVENTION

A method to introduce a flushing composition into a heat exchanger, such as an air conditioning or a refrigeration system is provided. The method combines compressed nitrogen and flushing composition at an injection or outlet port to enhance the cleaning efficiency.

The present invention is also directed to a flushing composition useful in cleaning of air conditioning and refrigeration systems. The composition contains a chemical that acts as a neutralizing agent. In a particularly preferred embodiment, the invention relates to a composition containing alkali hydroxide and/or organic amines. The composition may further contain a glycol ether and further may be free of chlorinated solvents.

BRIEF DESCRIPTION OF THE DRAWINGS

In order to more fully understand the drawings referred to in the detailed description of the present invention, a brief description of each drawing is presented, in which:

FIG. 1 illustrates a delivery vessel which may be used in the method of the invention for cleaning the interior surface of a heat exchanger.

DETAILED DESCRIPTION OF THE PREFERRED EMBODIMENTS

Cleaning of an interior surface of a heat exchanger may be enhanced by introducing to the surface of the heat exchanger a mixture of a flushing composition and a gas. The method described herein has particular applicability in the cleaning of air conditioning and refrigeration systems.

The flushing composition and gas may be mixed at room temperature. The method described is especially efficient in the cleaning of internal surfaces of an air conditioning or refrigeration system.

The mixture of flushing composition and gas may be introduced under pressure through a delivery vessel. Exemplary of the delivery vessel is that illustrated in FIG. 1.

The vessel 10 contains an inlet port 20 for introducing into the vessel a gaseous stream. The pressure of entry of gaseous stream into vessel is from about 5 to about 150 psi. Vessel 10 further contains central tube 30. Central tube 30 extends from the uppermost portion of top 15 of vessel 10. Top 15 may be an integral part of bottom 18 of vessel 10 such that top 15 and bottom 18 unitarily form a one piece vessel 10. Alternatively, top 15 may be a component separate from bottom 18 of vessel 10 which is secured onto bottom 18.

The central tube has a bottom port 40 for entry of the flushing composition as a feedstream through delivery vessel 10. The central tube further contains an outlet port 60. The heat exchanger is affixed to vessel 10 by tubing which attached to outlet port 60.

In a preferred embodiment, the diameter of the bottom hole 40 is from about 0.03 mm to about 3 mm and the diameter of outlet port 60 is from about 1 mm to about 10 mm.

The flushing composition 50 may be introduced into the delivery vessel on-site. Preferably, however, the flushing composition is added to the vessel off-site. Labor on on-site is therefore limited to affixing the nitrogen source onto inlet port 20 and affixing the tubing from outlet port 60 onto the heat exchanger.

In addition to bottom port 40, central tube 30 further contains side port 70. Side port 70 is located at upper portion of central tube 30. Gaseous stream entering inlet port 20 flows downward into vessel 10 or enters central tube 30 through side port 70. The diameter of the side port 70 is from about 0.03 mm to about 3 mm.

Pressure is applied onto the gaseous stream such that the gaseous stream entering inlet port 20 is forced into the vessel above the meniscus of flushing composition 50. While a portion of the gaseous stream may mix with flushing composition 50, the majority of the gaseous stream serves to push flushing composition 50 through bottom port 40 through central tube 30 and out of the vessel through outlet port 60. Hosing 80 connects outlet port 60 to heat exchanger 90. Vessel 10 further preferably contains pressure relief valve 100.

Gas entering central tube 30 from side port 70 is admixed with flushing composition 50 which enters central tube 30 at bottom port 40. A gaseous mixture containing the flushing composition is further propelled out of vessel 10 through outlet port 60 onto the interior surface of heat exchanger 90. The volume ratio of gas:liquid in the mixture propelled through outlet port 60 of central tube 30 onto the heat exchanger is typically between from about 1:1 to about 1:1000, preferably from about 1:10 to about 1:500, more preferably from about 1:50 to about 1:300, most preferably 1:200.

The vessel may be made of any material capable of delivering the liquid into the heat exchanger. In a preferred embodiment, the vessel is made of aluminum.

A preferred flushing composition is one which contains at least one acid neutralizing agent and one solvent. For example, the flushing composition may be composed of from about 1 to about 99 weight percent of at least one organic solvent and from about 0.1 to about 10 weight percent of an acid neutralizing agent. In the preferred flushing composition for use in the invention the composition does not contain any chlorinated hydrocarbon.

The preferred solvent is a fluorine-containing compound. Exemplary of such compounds are fluorine-containing hydrocarbons, preferably those where the only halogen in the compound is fluorine. Typically, such hydrocarbons contain at least one C—H bond as well as C—F bonds. Typical solvents include fluoromethanes and fluoroethanes such as monofluoromethane; trifluoromethane; difluoromethane, tetrafluoromethane; 1,1,1-trifluoroethane; 1,1-difluoroethane, 1,1,2,2-tetrafluoroethane; 1,1,1,2-tetrafluoroethane; pentafluoroethane; and hexafluoroethane. Further preferred are those fluorinated hydrocarbons containing more than three carbon atoms such as 1,1,1,2,2-pentafluoropropane; 1,1,1,3,3-pentafluoropropane; and 1,1,1,3,3,3-hexafluoropropane; and 1,1,1,2,3,4,5,5,5 decafluoropentane. Fluorinated alcohols may also be used as the solvent including fluorinated primary, secondary and tertiary alcohols such as 2,2,2-trifluoro-1-ethanol, 2-monochloro-2,2-difluoro-1-ethanol, 2,2-difluoro-1-ethanol, 2-monofluoro-1-ethanol, 3,3,3,2,2-pentafluoro-1-propanol, 3,3,2,2-tetrafluoro-1-propanol, 4,4,4,3,3,2,2-heptafluoro-1-butanol, 4,4,4,3,2,2-hexafluoro-1-butanol, 5,5,4,4,3,3,2,2-octafluoro-1-pentanol, 5,5,5,4,4,3,2,2-octafluoro-1-pentanol, 7,7,6,6,5,5,4,4,3,3,2,2-dodecafluoro-1-heptanol, 2-(1,1,1-trifluoroethyl)-1-hexanol, 8,8,7,7,6,6,5,5,4,4,3,3-dodecafluoro-1-octanol, 2-(pentafluoroethyl)-1-hexanol, 2-(1,1,1-trifluoroethyl)-2-fluoro-1-hexanol, 2-(pentafluoroethyl)-2-fluoro-1-hexanol, 7,7,7-trifluoro-1-heptanol, 6,6,6-trifluoro-1-hexanol, 2,2,3,3-tetrafluoro-1-hexanol, 2,2,3,3-tetrafluoro-1-heptanol, 2,2,3,3-tetrafluoro-1-octanol, 6,6-difluoro-1-hexanol, 7,7-difluoro-1-heptanol, 8,8-difluoro-1-octanol, 2-(pentafluorophenyl)ethanol, 2,3,4,5,6-pentafluorobenzyl alcohol, 2-(2,3-difluorophenyl)ethanol, 3,3,3-trifluoro-2-(2,3-difluorophenyl)-1-propanol, and 3,3,3-trifluoro-2-(2,2-difluorocyclohexyl)-1-propanol. Specific examples of fluorinated secondary alcohols include 4,4,3,3,1,1,1-heptafluoro-2-butanol, 1,1,1-trifluoro-2-octanol, 1,1,1-trifluoro-2-nonanol, 6,6,5,5,4,4,3,3,2,2-decafluoro-1-methyl-1-hexanol, 6,6,6,5,5,4,4,3,3,2,2-undecafluoro-1-methyl-1-hexanol, and 2,2,3,3,4,4,5,5-octafluoro-1-methyl-1-pentanol. Specific examples of fluorinated tertiary alcohols include 7,7,7,6,6,5,5,4,4,3,3,2,2-tridecafluoro-1,1-dimethyl-1-heptanol, 2,2,3,3-tetrafluoro-1,1-dimethyl-1-propanol, 1,1,1-trifluoro-2-phenyl-2-propanol, 1,1,1,3,3,3-hexafluoro-2-phenyl-2-propanol, and 1,1,1,3,3,3-hexafluoro-2-(p-tolyl)-2-propanol.

Further solvents may be fluorinated ethers, such as those of the formula $R_f$—O—R, wherein $R_f$ contains at least one fluorine atom and R contains no fluorine atoms and further wherein $R_f$ and R contain an alkyl, aryl or alkylaryl group or a derivative. Optionally, one or both of $R_f$ and R may contain one or more heteroatoms, such as nitrogen, oxygen, or sulfur, and/or one or more halogen atoms, including chlorine, bromine, or iodine. $R_4$ and R may also optionally contain one or more functional groups, including carbonyl, carboxyl, thio, amino, amide, ester, ether, hydroxy, and mercaptan groups, $R_f$ and R may also be linear, branched, or cyclic alkyl groups, and may contain one or more unsaturated carbon-carbon bonds. More preferably, R is a noncyclic branched or straight chain alkyl group, such as methyl, ethyl, n-propyl, iso-propyl, n-butyl, iso-butyl, or t-butyl, and $R_f$ is a fluorinated derivative of such a group. In a preferred embodiment, $R_f$ and R are chosen so that the compound has at least three carbon atoms, and the total number of hydrogen atoms in the compound is most equal to the number of fluorine atoms. Specific examples of such fluorinated ethers include $C_3F_7OCH_3$, $C_3F_7OC_2H_5$, $C_4F_9OCH_3$ and $C_4F_9OC_2H_5$. Other fluorinated ethers include those of the formula $R_2CHOCF_3$ wherein each R independently is selected from the group consisting of H, $(CF_2)_nF$ and $(CF_2)_nH$, where n is an integer from 1 to 10.

Further, preferred solvents are brominated hydrocarbon solvents, such as hydrobromocarbons like n-propyl bromide.

Other preferred solvents are glycol ethers and glycol monoalkyl ether esters of monocarboxylic acids as well as mixtures thereof. Preferred glycol ethers include polyoxyalkylene glycol ethers like $CH_3OCH_2CH(CH_3)O(H$ or $CH_3)$ (propylene glycol methyl (or dimethyl)ether), $CH_3O[CH_2CH(CH_3)O]_2(H$ or $CH_3)$ (dipropylene glycol methyl (or dimethyl)ether), $CH_3O[CH_2CH(CH_3)O]_3(H$ or $CH_3)$ (tripropylene glycol methyl (or dimethyl)ether), $C_2H_5OCH_2CH(CH_3)O(H$ or $C_2H_5)$ (propylene glycol ethyl (or diethyl)ether), $C_2H_5O[CH_2CH(CH_3O]_2(H$ or $C_2H_5)$ (dipropylene glycol ethyl (or diethyl)ether), $C_2H_5O[CH_2CH(CH_3)O]_3(H$ or $C_2H_5)$ (tripropylene glycol ethyl (or diethyl)ether), $C_3H_7OCH_2CH(CH_3)O(H$ or $C_3H_7)$ (propylene glycol n-propyl (or di-n-propyl) ether), $C_3H_7O[CH_2CH(CH_3)O]_2(H$ or $C_3H_7)$ (dipropylene glycol n-propyl (or di-n-propyl)ether), $C_3H_7O[CH_2CH(CH_3)O]_3(H$ or $C_3H_7)$ (tripropylene glycol n-propyl (or di-n-propyl)ether), $C_4H_9OCH_2CH(CH_3)OH$ (propylene glycol n-butyl ether), $C_4H_9O[CH_2CH(CH_3)O]_2(H$ or $C_4H_9)$ (dipropylene glycol n-butyl (or di-n-butyl)ether), $C_4H_9O[CH_2CH(CH_3)O]_3(H$ or $C_4H_9)$ (tripropylene glycol n-butyl (or di-n-butyl)ether), $(CH_3)_3COCH_2CH(CH_3)OH$ (propylene glycol t-butyl ether), $(CH_3)_3CO[CH_2CH(CH_3)O]_2(H$ or $(CH_3)_3$) (dipropylene glycol t-butyl (or di-t-butyl)ether), $(CH_3)_3CO[CH_2CH(CH_3)O]_3$(H or $(CH_3)_3$) (tripropylene glycol t-butyl (or di-t-butyl)ether), $C_5H_{11}$ $OCH_2CH(CH_3)OH$ (propylene glycol n-pentyl ether), $C_4H_9OCH_2CH(C_2H_5)OH$ (butylene glycol n-butyl ether), $C_4H_9O[CH_2CH(C_2H_5)O]_2H$ (dibutylene glycol n-butyl ether), trimethylolpropane tri-n-butyl ether ($C_2H_5C(CH_2—O—(CH_2)_3CH_3)_3$) and trimethylolpropane di-n-butyl ether ($C_2H_5C(CH_2OC(CH_2)_3CH_3)_2CH$. In a preferred embodiment, the glycol ether is propylene glycol tert-butyl ether.

Preferred glycol monoalkyl ether esters of monocarboxylic acids include glycol acetates, such as ethylene glycol monomethyl ether acetate, ethylene glycol monoethyl ether acetate and diethylene glycol monoethyl acetate.

The preferred neutralizing agent is alkali hydroxide, such as sodium hydroxide, calcium hydroxide or magnesium hydroxide, or an organic amine. Preferred organic amines include aliphatic monoamines having at least 1, carbon atoms, for example, primary amines such as methylamine, heptylamine, secondary amines such as dihexylamine, and tertiary amines such as trioctylamine; aliphatic polyamines, for example, alkylene diamines such as trimethylenediamine and hexamethylenediamine; polyalkylenepolyamines, for example, polyethylenepolyamines having a polymerization degree of 2 to 6, such as triethylenetetramine; alicyclic amines such as cyclohexylamine, dicyclohexylamine, isophoronediamine and dicyclohexylmethanediamine; aromatic amines such as benzylamine, dibenzylamine and xylenediamine; heterocyclic amines such as morpholines, aminothiazoles, imidazoles, piperidines, pyrazoles, pyrazolines, piperazines, pyrrolidines, indoles and quinolines; and hydroxyalkyl-substituted products of these amines, or addition products obtained by adding 1 to 10 mols of alkylene oxide to these amines, for example, diethylaminoethanol and morpholinemonoethyleneoxide; and alkanolamines, such as mono-, di- or triethanolamine, propanolamine, butanolamine and diethylaminoethanol.

The flushing composition of the invention may further contain other additives, when desired, such as, for example, anti-rust additives, biocides, scale inhibitors, and corrosion inhibitors. The flushing composition may also include a propellant such as carbon dioxide, nitrogen or air.

A particularly preferred flushing composition is one which contains from about 30 to about 99.8 weight percent of n-propyl bromide. Another particularly preferred flushing composition is one which contains from about 30 to about 90 weight percent of propylene glycol tert-butyl ether; from about 20 to about 90 weight percent of propylene glycol methyl acetate; from about 0.1 to about 10 weight percent of an organic amine; from 0 to about 2 weight percent of a stabilizer; and from 0 to about 3 weight percent of propellant.

The flushing agent composition of the invention may be prepared by admixing each of the components together at room temperature until homogeneous.

While focusing on the air conditioning and refrigeration industry, the present invention can be used in other industries for cleaning and flushing of various systems. For example, the flushing composition is safe and compatible as a flush and/or cleaning agent for use in automotive and other mobile air conditioning and refrigeration systems.

The following examples show the preparation and use of the flushing composition of the invention and is offered for illustrative purposes and not intended to limit or define the invention in any manner. It is intended that the specification, together with the examples, be considered exemplary only, with the scope and spirit of the invention being indicated by the claims which follow.

All percentages set forth in the Examples are given in terms of weight units except as may otherwise be indicated.

EXAMPLES

Example 1

A 500 ml aluminum container, a 5 mm diameter copper central tube with 1 mm diameter bottom port and 1 mm diameter side port, with an inlet and outlet was assembled as shown in FIG. 1. N-propyl bromide was filled in the vessel and external compressed air was connected to the inlet port. The flow rate of n-propyl bromide and air was measured as shown in Table 1.

TABLE 1

| Pressure, psi | Air, ml/s | N-propyl bromide, ml/s |
|---|---|---|
| 20 | 320 | 7 |
| 40 | 540 | 11 |
| 60 | 870 | 16 |

Example 2

A 900 ml aluminum container, a 8 mm diameter copper central tube with 0.5 mm diameter bottom port and 0.9 mm diameter side port, with an inlet and outlet was assembled as shown in FIG. 1. Technical grade of 1,1,1,2,3,4,5,5,5 decafluoropentane was filled in the vessel and external nitrogen source was connected to the inlet port. The flow rate of 1,1,1,2,3,4,5,5,5 decafluoropentane and nitrogen at various pressures was measured and is listed in Table 2.

TABLE 2

| Pressure, psi | Nitrogen, ml/s | decafluoropentane,, ml/s |
|---|---|---|
| 20 | 290 | 3 |
| 40 | 500 | 4 |
| 60 | 870 | 5 |

Example 3

500 grams of diacetone alcohol, 600 grams of propylene glycol methyl ether, 1 gram of potassium hydroxide were mixed in a one gallon plastic container. The mixture was colorless and had a alkalinity of 900 mg per liter.

Example 4

200 grams of propylene glycol tert butyl ether, 200 grams of propylene glycol ethyl acetate, and 2 grams of methyl amine were mixed in a 1000 ml glass beaker and filled into a 16 oz aluminum container. The apparatus of Example 2 was used and the inlet was connected to a nitrogen source at 40 psi. The outlet of the apparatus was connected to a used evaporator coil. The liquid was dispensed into the coil and brownish debris was carried out from the other end of the coil.

The foregoing disclosure and description of the invention is illustrative and explanatory thereof, and various changes in the size, shape, and materials, as well as in the details of illustrative construction and assembly, may be made without departing from the spirit of the invention.

What is claimed is:

1. A method for cleaning an interior surface of a heat exchanger and acid residues therefrom, the method comprising:

(a) introducing under pressure a gaseous stream into a delivery vessel, the delivery vessel containing:
  (i) a liquid flushing composition;
  (ii) a gaseous stream inlet port; and
  (ii) a central tube having a bottom feed entry port, a top outlet port, and a side port at the upper portion of the central tube, wherein the top outlet port connects to the heat exchanger, wherein the diameter of the bottom feed entry port is smaller than the diameter of the central tube;
(b) propelling the liquid flushing composition through the bottom feed entry port of the central tube;
(c) mixing the liquid flushing composition in the central tube with the gaseous stream entering the side port;
(d) propelling the mixture of liquid flushing composition and gaseous stream through the top outlet port of the central tube onto the heat exchanger; and
(e) removing acid residues from the interior surface of the heat exchanger.

2. The method of claim 1, wherein the heat exchanger is an air conditioning or refrigeration system.

3. The method of claim 1, wherein the diameter of the bottom feed entry port is from about 0.03 mm to about 3 mm and the diameter of the side port is approximately from about 0.03 mm to about 3 mm.

4. The method of claim 1, wherein the volume ratio of gas:liquid in the mixture propelled through the outlet port of the central tube onto the heat exchanger is between from about 1:1 to about 1:1000.

5. The method of claim 4, wherein the volume ratio of gas:liquid in the mixture propelled through the outlet port of the central tube onto the heat exchanger is between from about 1:10 to about 1:500.

6. The method of claim 5, wherein the volume ratio of gas:liquid in the mixture propelled through the outlet port of the central tube onto the heat exchanger is between from about 1:50 to about 1:300.

7. The method of claim 1, wherein the diameter of the bottom feed entry port is from about 0.03 mm to about 3 mm and the diameter of the top outlet port is from about 1 mm to about 10 mm.

8. A method for cleaning an interior surface of a heat exchanger and removing acid residues from the heat exchanger, the method comprising introducing under pressure a mixture of a gaseous stream and a liquid flushing composition through a delivery vessel and propelling the mixture through an outlet port of the delivery vessel onto the interior surface of the heat exchanger, wherein the delivery vessel has a tube into which the liquid flushing composition and gaseous stream are introduced and further wherein the tube has at least two inlet openings.

9. The method of claim 8, wherein the heat exchanger is an air conditioning or refrigeration system.

10. The method of claim 8, wherein the liquid flushing composition is added to the delivery vessel off-site from where the heat exchanger is subjected to cleaning.

11. The method of claim 8, wherein the gaseous stream is selected from the group consisting of carbon dioxide, nitrogen, nitrous oxide and compressed air and mixtures thereof.

12. The method of claim 8, wherein the volume ratio of gas:liquid in the mixture propelled through the outlet port of the delivery vessel onto the heat exchanger is between from about 1:1 to about 1:1000.

13. The method of claim 8, wherein the liquid flushing composition comprises from about 1 to about 99 weight percent of at least one organic solvent and from about 0.1 to about 10 weight percent of an acid neutralizing agent and, optionally, a propellant.

14. The method of claim 13, wherein the organic solvent is n-propyl bromide, a glycol ether, a glycol acetate or a mixture thereof.

15. The method of claim 13, wherein the acid neutralizing agent is selected from the group consisting of organic amines, alkali hydroxides or a mixture thereof.

16. The method of claim 13, wherein the flushing composition comprises:

(a) from about 30 to about 90 weight percent of propylene glycol tert-butyl ether;
(b) from about 20 to about 90 weight percent of propylene glycol methyl acetate;
(c) from about 0.1 to about 10 weight percent of an organic amine;
(d) from 0 to about 2 weight percent of a stabilizer;
(e) from 0 to about 3 weight percent of propellant.

17. A method for cleaning an interior surface of a heat exchanger comprising:

(a) introducing a gaseous stream under pressure into a delivery vessel, the delivery vessel containing:
  (i) a bottom portion containing a liquid flushing composition;
  (ii) a tube extending from the bottom portion of the delivery vessel, the tube having a bottom port for entry of the liquid flushing composition into the bottom portion of the tube, wherein the diameter of the bottom port is smaller than the diameter of the tube;
  (iii) an inlet port for entry of the gaseous stream into the delivery vessel, the inlet port located above the liquid flushing composition in the bottom portion of the tube;
  (iv) a port on the tube for entry of the gaseous stream into the tube; and
  (v) a port at a top area of the delivery vessel for removal of the mixture of the liquid flushing composition and gaseous stream from the vessel;
(b) mixing the liquid flushing composition in the tube with the gaseous stream entering the inlet port; and
(c) propelling the mixture of liquid flushing composition and gaseous stream through the tube of the delivery vessel onto the interior surface of the heat exchanger.

18. The method of claim 17, wherein the heat exchanger is an air conditioning or refrigeration system.

19. The method of claim 17, wherein the volume ratio of gas:liquid in the mixture propelled through the port at the top area of the delivery vessel onto the heat exchanger is between from about 1:1 to about 1:1000.

20. The method of claim 19, wherein the volume ratio of gas:liquid in the mixture propelled through the port at the top area of the delivery vessel onto the heat exchanger is between from about 1:10 to about 1:500.

* * * * *